United States Patent [19]

Ushio et al.

[11] Patent Number: 4,757,790

[45] Date of Patent: Jul. 19, 1988

[54] ALUMINUM ALLOY SLIDE SUPPORT MEMBER

[75] Inventors: Hideaki Ushio; Tadayoshi Hayashi; Kazuo Shibata; Yoshikazu Fujisawa, all of Saitama, Japan

[73] Assignee: Honda Giken Kogyo Kabushiki Kaisha, Tokyo, Japan

[21] Appl. No.: 907,362

[22] Filed: Sep. 15, 1986

[30] Foreign Application Priority Data

Sep. 14, 1985 [JP] Japan ..... 60-203967
Sep. 25, 1985 [JP] Japan ..... 60-146385[U]

[51] Int. Cl.[4] ..... F02B 75/08
[52] U.S. Cl. ..... 123/193 C; 123/668
[58] Field of Search ..... 123/193 CH, 193 C, 41.74, 123/668, 195 R

[56] References Cited

U.S. PATENT DOCUMENTS

| | | | |
|---|---|---|---|
| 3,643,637 | 2/1972 | Strossner et al. | 123/193 C |
| 3,745,980 | 7/1973 | Pekar et al. | 123/41.74 |
| 4,444,603 | 4/1984 | Yamatsuta et al. | 428/614 |
| 4,457,979 | 7/1984 | Donomoto et al. | 428/614 |
| 4,480,601 | 11/1984 | Skatsche et al. | 123/41.74 |
| 4,530,314 | 7/1985 | Feichtinger | 123/41.74 |
| 4,544,610 | 10/1985 | Okamoto et al. | 428/614 |
| 4,547,435 | 10/1985 | Yamatsuta et al. | 428/614 |
| 4,590,132 | 5/1986 | Dohnomoto et al. | 428/614 |
| 4,595,638 | 6/1986 | Dohnomoto et al. | 428/610 |
| 4,616,603 | 10/1986 | Kubis et al. | 123/193 C |
| 4,643,078 | 2/1987 | Ban | 123/193 P |

FOREIGN PATENT DOCUMENTS

| | | | |
|---|---|---|---|
| 2140378 | 2/1973 | Fed. Rep. of Germany | 123/193 C |
| 0046066 | 3/1980 | Japan | 123/193 C |
| 1415507 | 11/1975 | United Kingdom . | |
| 1484980 | 9/1977 | United Kingdom . | |
| 1506476 | 4/1978 | United Kingdom . | |

OTHER PUBLICATIONS

German Publication "Aluminum-Taschenbuch", 14th Edition, pp. 148-152; Oct., 1983.

*Primary Examiner*—Charles J. Myhre
*Assistant Examiner*—David A. Okonsky
*Attorney, Agent, or Firm*—Lyon & Lyon

[57] ABSTRACT

An aluminum alloy slide support member which is disclosed herein as a cylinder block of an internal combustion engine includes a slide portion, such as the cylinder for slideably supporting the piston, made of a fiber-reinforced aluminum alloy containing at least an alumina fiber as a reinforcing material, wherein the alpha rate of the alumina fiber is set in a range of 10.0 to 50.0% and the volume content of the alumina fiber is set in a range of 8.0 to 20.0%. Another embodiment employs carbon fibers in addition to the alumina fibers. Further, the walls of the cylinder barrel are of a varying thickness to equalize the cooling and cause uniform thermal expansion of the cylinder barrel.

26 Claims, 8 Drawing Sheets

ALUMINUM ALLOY SLIDE SUPPORT MEMBER

THE FIELD OF THE INVENTION

The present invention relates to an aluminum alloy member for slidably supporting another member, and more particularly, to an improved aluminum alloy cylinder block for an engine wherein the cylinder portion for slidably supporting the pistons is made of a fiber-reinforced aluminum alloy containing at least an alumina fiber as a reinforcing material.

DESCRIPTION OF THE PRIOR ART

The use of aluminum alloy to form a support member, such as a cylinder block, for slidably supporting a moving member, such as the pistons or shafts, has been well known. However, insofar as applicant is aware, in such an aluminum alloy slide support member, the relationship between the proportion of the alpha phase of aluminum (hereinafter the "alpha rate") and the volume content of an alumina fiber has not been taken into special consideration.

However, the alpha rate of the alumina fiber has a significant influence on the strength and hardness of the fiber and hence, it is required to set the alpha rate at an appropriate value. If the volume content of the alumina fiber is inappropriate even though the strength of the alumina fiber is appropriate, then a problem arises that not only is the fiber reinforcement of the slide portion unsatisfactory but also there is an increase in the amount of wear of the slide portion and the mating material as well as a reduction in seizure resistance and heat conductivity occurring.

In addition, when the aforesaid slide member is a cylinder block for an internal combustion engine, such as a block of the siamese type having a cylinder block outer wall forming the outside of a water jacket and a siamese cylinder barrel portion having its outer periphery forming the inside of the water jacket, the siamese cylinder barrel portion comprising a plurality of cylinder barrels each having a cylinder bore and connected in series at their adjacent portions through connections with the thickness of each cylinder barrel being uniform around the circumference thereof and the slide portion being the inner wall of the cylinder bore, a number of problems are encountered. The cooling water in the water jacket tends to stagnate in the vicinity of the connection of the adjacent cylinder barrels but the rate of water flow gradually increases from the vicinity of such connection to a point lying on a diametrical line perpendicular to the direction in which the cylinder barrels are arranged. Because each cylinder barrel is made of an aluminum alloy to have a good heat conductivity, the cooling efficiency at a portion outwardly from the connection of each cylinder barrel is better than that at the vicinity of the connection and hence, the temperature of such portion becomes lower than that of the vicinity of the connection. When such a phenomenon occurs, the amount of thermal expansion in the vicinity of the connection of each cylinder barrel increases, so that the clearance between the inner wall of the cylinder bore and the piston ring increases at such portion, resulting in an increase in the amount of blow-by gas and in the consumption of oil.

SUMMARY OF THE INVENTION

It is an object of the present invention to provide a slide support member of a type as described above wherein the alpha rate and volume content of an alumina fiber in the support member are selected to provide high strength and good slide characteristics for the slide support member.

It is another object of the present invention to provide such a slide support member wherein a reinforcing material produced from the mixing of an alumina fiber and a carbon fiber is employed to further improve the slide characteristics.

It is a further object of the present invention to provide a siamese type cylinder block of a novel construction of the cylinder barrel slide member, wherein the amount of blow-by gas and the consumption of oil can be reduced.

To accomplish the above objects, according to the present invention, there is provided an aluminum alloy slide support member in which a slide portion is made of a fiber-reinforced aluminum alloy containing at least an alumina fiber as a reinforcing material, wherein the alpha rate of the alumina fiber is set in a range of 10.0 to 50.0% and the volume content of the alumina fiber is set in a range of 8.0 to 20.0%.

In addition, according to the present invention, there is provided an aluminum alloy slide support member in which a slide portion is made of a fiber-reinforced aluminum alloy wherein the reinforcing material consists of an alumina fiber and a carbon fiber with the alpha rate of the alumina fiber being set in a range of 10.0 to 50.0%, the volume content of the alumina fiber being set at 50% or less, and the volume content of the carbon fiber being set at 20.0% or less.

Further, according to one form of the present invention, there is provided a cylinder block of the siamese type including a cylinder block outer wall and a siamese type cylinder barrel portion forming a water jacket therebetween, with the siamese type cylinder barrel portion comprising a plurality of cylinder barrels each having a cylinder bore and connected in series through connections wherein the varying thicknesses of the cylinder barrels between the connection and a point lying on a line perpendicular to the direction of arrangement of the cylinder barrels gradually increase from the connection toward that point. Further, in another form of this invention the thickness of each cylinder barrel varies from end to end with the end nearer the cylinder head being thinner. These variations in wall thickness of the cylinder barrels provide a unique equalization of the temperature throughout the cylinder barrel walls for uniform thermal expansion.

The above and other objects, features and advantages of the invention will become apparent from reading of the following description of the preferred embodiments taken in conjunction with the accompanying drawings.

DESCRIPTION OF THE PREFERRED EMBODIMENTS

Figure 1:
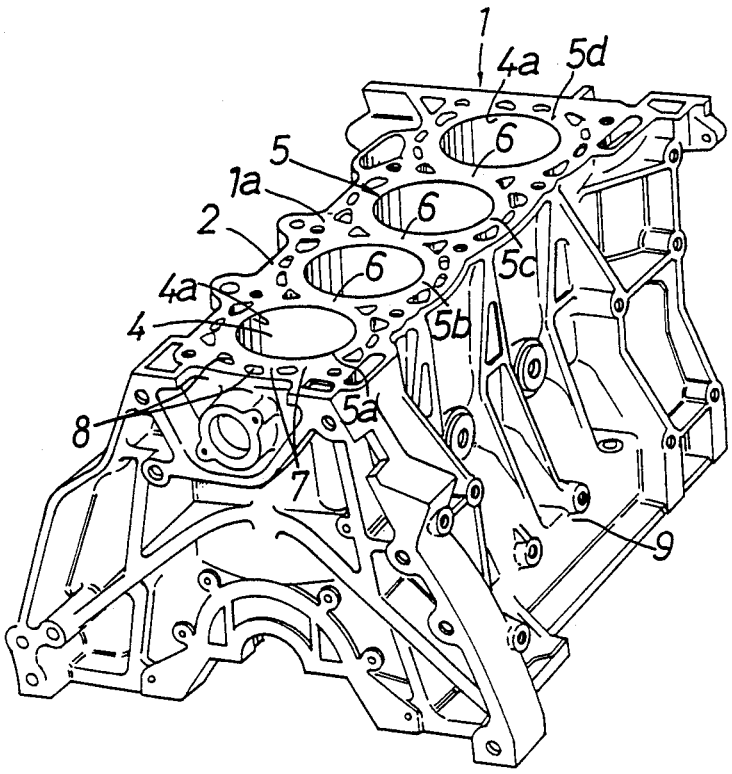
FIG. 1 is a perspective view of a siamese type cylinder block.
Figure 2:
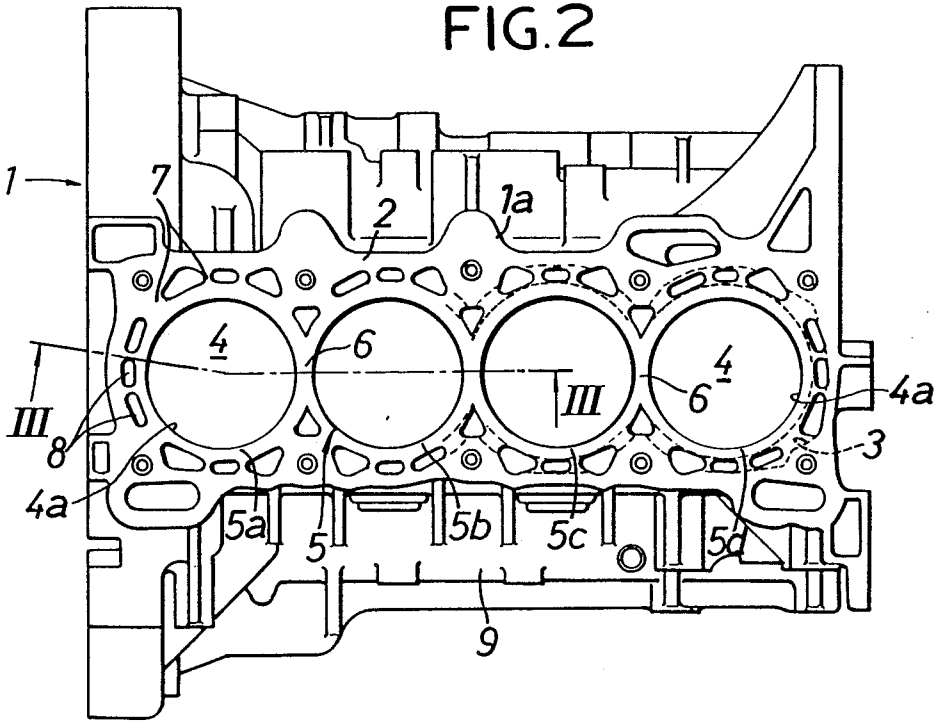
FIG. 2 is a plan view of the siamese type cylinder block of FIG. 1.
Figure 3:
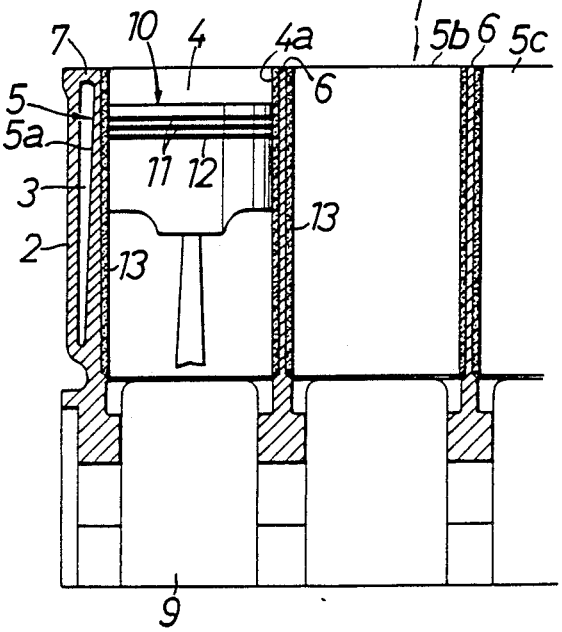
FIG. 3 is a sectional elevation view taken along the line III—III of FIG. 2.

FIGS. 1 to 3 shows a siamese type cylinder block 1 as a slide support member made of an aluminum alloy. The cylinder block 1 comprises a cylinder block outer wall 2, a water jacket 3 provided inside the outer wall 2, and a siamese cylinder barrel portion 5 having an outer periphery forming the inside of the water jacket 3. The siamese cylinder barrel portion 5 is constituted of a plurality of (four in the illustrated embodiment) cylinder barrels 5*a* to 5*d* each having a cylinder bore 4 and connected in series to each other through connections 6 between the cylinders.

At the upper end of the water jacket 3 is a surface 1*a* which is to be bonded to a cylinder head. The cylinder block outer wall 2 and the individual cylinder barrels 5*a* to 5*d* are partially connected by a plurality of reinforcing deck portions 7 in the upper surface 1*a*, whereby the cylinder block 1 is of a so-called closed deck type. The open portions between the adjacent reinforcing deck portions 7 serve as communication holes 8 for conducting coolant water between the cylinder block 1 and the cylinder head, not shown. The lower portion of the cylinder block 1 is formed into a crank case 9. As thus far described, the cylinder block 1 is of a conventional construction.

The inner wall 4*a* of each cylinder bore 4 serving as a slide support portion for a piston 10 is formed of a fiber-reinforced aluminum alloy layer of sleeve portion 13 using an alumina fiber as a reinforcing material which will be described in greater detail below. A piston 10 of an aluminum alloy is slidably fitted in each cylinder bore 4 and has two compression rings 11 and a single oil ring 12 mounted thereon.

The cylinder block 1 is cast by placing a cylindrical shaped tube or sleeve member of a matrix of alumina fiber preheated to a temperature of 300° C. into each cylinder cavity of the casting mold preheated to a temperature of 200° C., and casting a molten metal of an aluminum alloy, such as aluminum alloy specified as JIS ADC12, into the cavity at a temperature of 730° to 740° C. under a filling pressure of 260 kg/cm$^2$. During casting of the cylinder block, the aluminum alloy is filled into and compounded to the shaped matrix of fiber, so that the fiber-reinforced aluminum alloy layer or sleeve portion 13 is formed.

The alumina fibers which may be used in the present invention are long and short fibers and whiskers, including, for example, Saffil (a trade name) commercially available from ICI Corp., and Fiber FP (a trade name) commercially available from E.I., du Pont de Nemours and Company.

Figure 4:
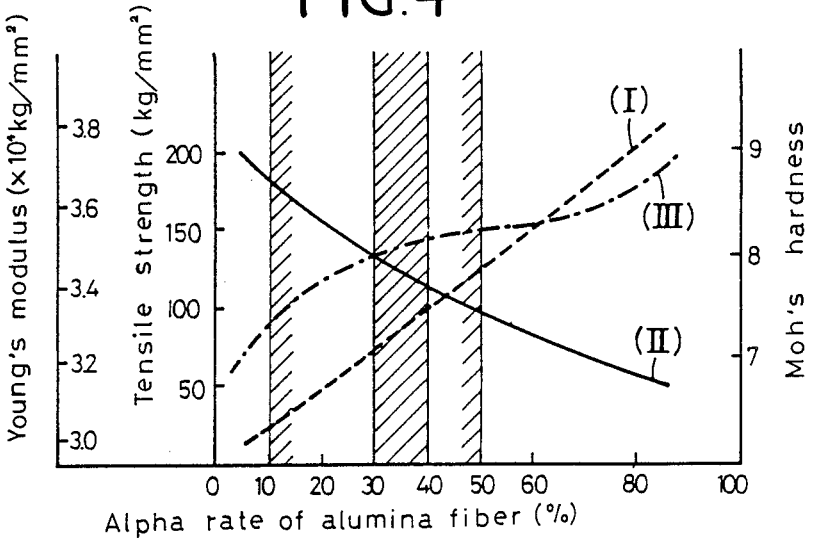
FIG. 4 is a graph illustrating the relationship between the alpha rate and the tensile strength of an alumina fiber.

FIG. 4 illustrates the relationship of the alpha rate with the Young's modulus (I), the tensile strength (II) and the Moh's scale of hardness (III) for the aluminum fiber. If the alpha rate of the alumina fiber is in a range of 10.0 to 50.0%, a high strength and a scratch hardness, i.e., Moh's hardness, suitable for a slide member can be retained in the alumina fiber. It is preferred for this purpose to employ alumina fiber with an alpha rate in a range of 30.0 to 40.0% whereby the alumina fiber has less of a decrease in tensile strength and a higher scratch hardness and therefore this type of alumina fiber produces optimum slide characteristics.

Figure 5:
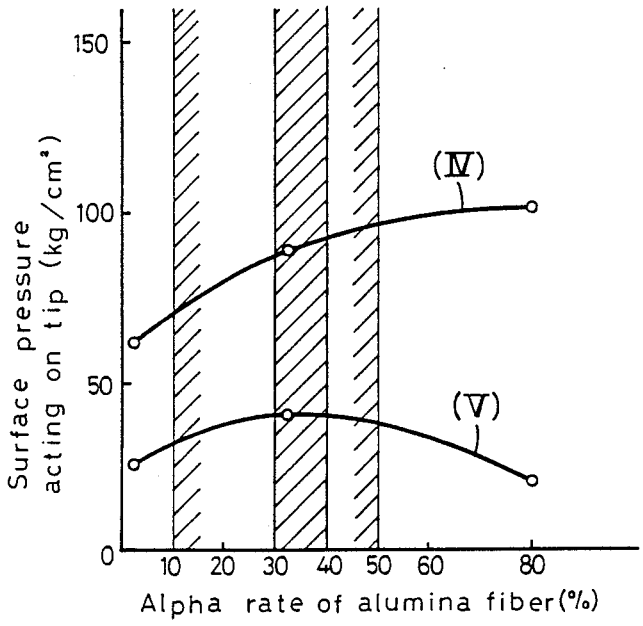
FIG. 5 is a graph illustrating the slide characteristics in the relationship between the alpha rate of the alumina fiber and the surface pressure acting on a tip.

FIG. 5 illustrates the results of a tip-on-disk sliding test for fiber-reinforced aluminum alloys containing alumina fibers having a volume content set at a value of 12% and various different alpha rates and using a spheroidal graphite cast iron (JIS FCD75) as a mating material, wherein the line IV designates a seizure limit characteristic and the line V denotes a scratch limit characteristic. The aforesaid alloy corresponds to the material forming the inner wall 4*a* of the cylinder bore 4 and such material is used to form a tip. The aforesaid cast iron corresponds to a material forming the compression rings 11 and such a material is used to form the disk. The testing method involves rotating the disk at a speed of 9.5 m/second and pressing the slide surface of the tip onto the slide surface of the disk with a predetermined pressing force under no lubrication to determine the relationship between the alpha rate of the alumina fiber contained in each tip and the surface pressure acting on the tip at a seizure limit and a scratch limit.

As apparent from FIG. 5, if the alpha rate of the alumina fiber is in a range of 10.0 to 50.0%, the surface pressure on the tip at the scratch limit is 35 to 40 kg/cm$^2$ and the surface pressure at the seizure limit is as high as 70 to 90 kg/cm$^2$. Thus, with the alpha rate of the alumina fiber in a range of 30.0 to 40.0%, the surface pressure on the tip at the scratch limit is highest and the surface pressure at the seizure limit is also higher, and therefore an optimum slide characteristic for practical use can be provided.

It has been confirmed in the aforesaid sliding test that if the alpha rate of the alumina fiber exceeds 50.0% the amount of alumina fiber which falls off the aluminum alloy matrix tends to increase and that such fallen-off alumina fiber increases the wearing of the tip.

Figure 6:
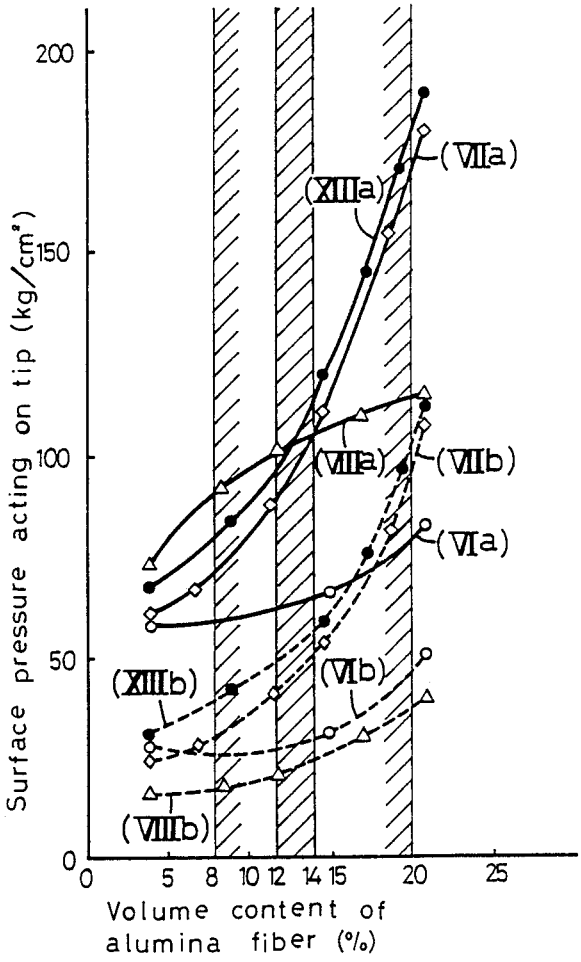
FIG. 6 is a graph illustrating the slide characteristics in the relationship between the volume content of the alumina fiber and the surface pressure acting on the tip.

FIG. 6 illustrates the results of the tip-on-disk sliding test for fiber-reinforced aluminum alloys containing alumina fiber with the alpha rates set at 3%, 33% and 80% and the volume content of fibers at different values wherein a spheroidal graphite cast iron (JIS FCD75) is used as the mating material, and wherein lines VIa, VIIa and VIIIa represent seizure limit characteristics at the alpha rates of 3%, 33% and 80%, respectively, and lines VIb, VIIb and VIIIb designate scratch limit characteristics at the alpha rates of 3%, 33% and 80%, respectively. The aforesaid alloy corresponds to the material forming the inner wall 4*a* of the cylinder bore and such material is used to form the tip. The aforesaid cast iron corresponds to a material forming the above-mentioned compression rings 11 and such a material is used to form the disk. The testing method involves rotating the disk at a speed of 9.5 m/second, and pressing the slide surface of the tip onto the slide surface of the disk with a predetermined pressing force under no lubrication to determine the relationship between the volume content of the alumina fiber in each tip with selected alpha rates and the surface pressure acting on the tip at a seizure limit and a scratch limit.

As shown by lines VIIa and VIIb of FIG. 6, for example, if the volume content of the alumina fiber having an alpha rate of 33% is set at 8.0 to 20.0%, then the surface pressure on the tip at the scratch limit is from 30 to 95 kg/cm$^2$ as indicated by the line VIIb and the surface pressure at the seizure limit is as high as 70 to 170 kg/cm$^2$ as indicated by the line VIIa.

As already mentioned, if the volume content is less than 8.0%, the seizure resistance decreases, whereas if the volume content exceeds 20.0%, the ability of the aluminum alloy to fill the matrix (so-called "fillability") in the alumina fiber deteriorates. Therefore, it is appropriate to examine the seizure limit when the alumina fiber volume content is in a range of 8.0 to 20.0%, as described above.

In FIG. 6, the lines XIIIa and XIIIb, respectively, denote the seizure limit characteristic and scratch limit characteristic of a tip made of a hybrid fiber-reinforced aluminum alloy which is produced using an alumina fiber having an alpha rate of 33% and containing a carbon fiber mixed therein. In this case, the volume content of the carbon fiber (based on the entire volume of the tip) has been set at 3%. For the tip of the hybrid type, it is apparent that the seizure and scratch limit characteristics thereof are improved as compared with those indicated by the lines VIIa and VIIb for a tip without carbon fibers.

However, if the carbon fiber volume content is less than 0.3%, the aforesaid beneficial effect is not achieved and if that volume content exceeds 20.0%, the total fiber volume content increases in relationship to the quantity of the alumina fiber and thus the moldability for producing a molded product using such mixed fibers is reduced. Accordingly, it has been found that the carbon fiber volume content may be of 0.3 to 20.0%, preferably 3.0 to 12.0%.

In addition, in the mixed fiber reinforcing material, the mixing of the carbon fiber permits the volume content of the alumina fiber to be reduced as compared with that in the use of the alumina fiber alone, because the carbon fiber has the effect of improving the wear and seizure resistances. However, if the alumina fiber volume content is less than 5.0%, the desirable properties of the alumina fiber are not exhibited, whereas if that volume content of alumina fiber exceeds 50.0%, the total volume content of fibers increases in relationship to the quantity of the carbon fiber which results in a reduced fillability of the matrix. Accordingly, it has been found that the alumina fiber volume content may be of 5.0 to 50.0%, preferably 10.0 to 50.0%.

In relation to the cylinder block 1 of FIGS. 1–3, the aforesaid hybrid fiber-reinforced aluminum alloy comprises the layer or sleeve portion 13 forming the inner wall 4*a* of the cylinder bore 4.

Figure 7:
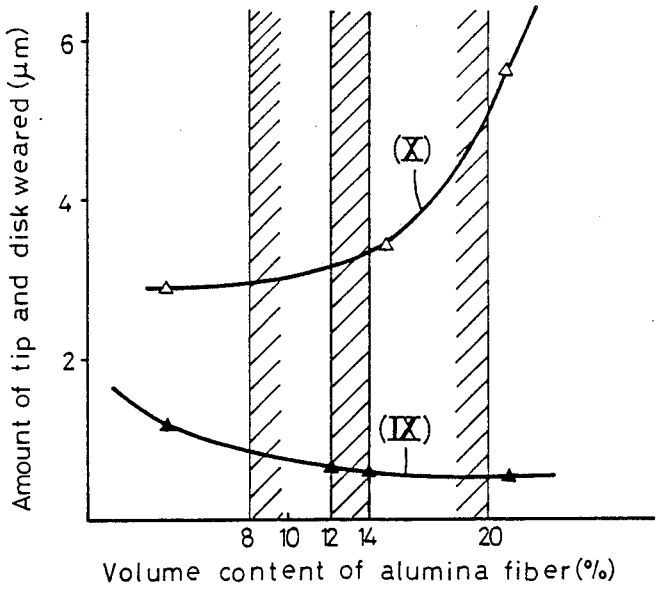
FIG. 7 is a graph illustrating the relationship between the volume content of the alumina fiber and the amount of tip wear.

FIG. 7 illustrates the results of a tip-on-disk sliding test for fiber reinforced aluminum alloys containing alumina fibers having an alpha rate set at 35% with their volume contents varied at various values and a spheroidal graphite cast iron (JIS FCD75) as a mating material, wherein a line IX corresponds to the amount of alloy wear and a line X corresponds to the amount of castiron wear. The aforesaid alloy is the material forming the inner wall 4*a* of the cylinder bore 4, and such material is used to form the tip. In addition, the aforesaid cast iron is the material forming the above-mentioned compression rings 11, and such material is used to form the disk. This testing method includes rotating the disk at a speed of 2.5 m/second, and pressing the slide surface of the tip onto the slide surface of the disk with a pressing force of 20 kg/cm$^2$ with lubrication of 2 to 3 mR of oil per meter of travel and maintaining such state until the sliding distance or travel reached a value of 2,000 m.

As apparent from FIG. 7, if the volume content of the alumina fiber having an alpha rate of 35% is set in a range of 8.0 to 20.0%, the amount of tip wear is as small as 0.5 to 0.85 μm, as indicated by the line IX and the amount of disk wear is also as small as 2.85 to 5 μm, as indicated by the line X. To reduce the amount of tip and disk wear to the optimum, the volume content of the alumina fiber may be set in a range of 12.0 to 14.0%.

Figure 8:
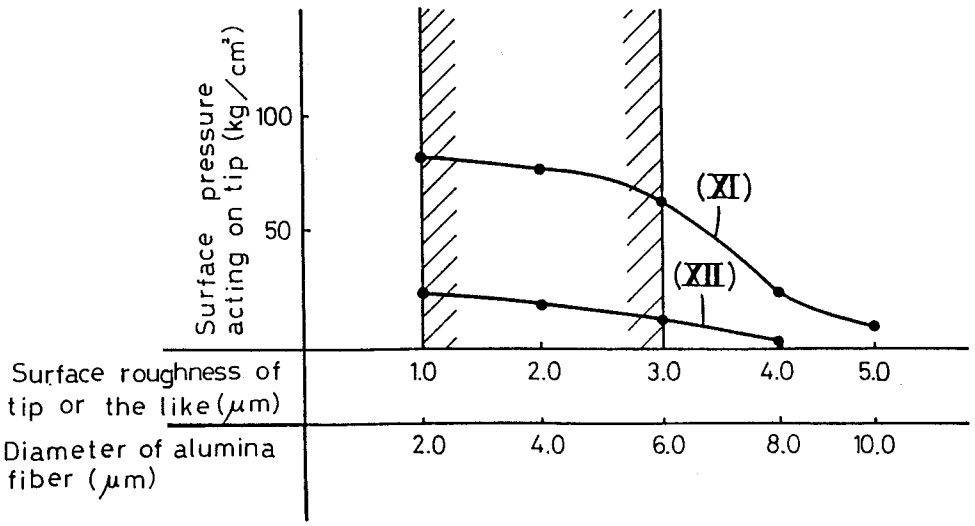
FIG. 8 is a graph illustrating the slide characteristics in the relationship between the surface roughness of a tip and the surface pressure acting on the tip.

FIG. 8 illustrates the results of a tip-on-disk sliding test for fiber-reinforced aluminum alloys containing alumina fibers having various diameters and an alpha rate set at 35% with the volume content thereof set at 8% and a spheroidal graphite cast iron (JIS FCD75) as a mating material, wherein a line XI corresponds to a seizure limit characteristic and a line XII corresponds to a scratch limit characteristic. The above alloy is the material forming the inner wall 4*a* of the cylinder bore 4 and such material is used to form the tip. In addition, the above cast iron is the material forming the previously-described compression rings 11 and such material is used to form the disk. The slide surfaces of the tip and disk are subjected to a grinding to have various surface roughnesses larger than 1.0 μm. The reason the surface roughnesses are set at values larger than 1.0 μm is that it is difficult to provide a surface roughness less than 1.0 μm by grinding. The testing method involves rotating the disk at a speed of 9.5 m/second and pressing the slide surface of the tip onto the slide surface of the disk with a predetermined pressing force under no lubrication to determine the relationship between the surface roughness of each tip and the surface pressure acting on the tip at a seizure limit and a scratch limit.

As apparent from FIG. 8, if the surface roughness of the tip is in a range of 1.0 to 3.0 μm, the surface pressure at the scratch limit is of 12 to 23 kg/cm$^2$ (line XII) and the surface pressure at the seizure limit is as high as 66 to 82 kg/cm$^2$ (line XI) and thus, a slide characteristic satisfactory for practical use can be provided.

In the sliding test for such a fiber-reinforced aluminum alloy tip and such a cast iron disk, the scratch and seizure phenomena are promoted by the alumina fiber falling off the tip matrix during the sliding test. Therefore, it is necessary to firmly hold the alumina fiber in the matrix, and in order to satisfy this requirement, the surface roughness of the tip may be set less than a value half the average diameter of the alumina fiber. In doing so, the alumina fiber distributed in the slide surface of the tip with the fiber axis substantially parallel to such slide surface is held in the matrix with substantially half of the fiber buried in the matrix, whereby the falling-off of the alumina fiber is suppressed. On the other hand, the alumina fiber distributed with the axis substantially perpendicular to such slide surface has a larger amount buried in the matrix and hence is less related to the surface roughness.

In view of the above, the surface roughness, when the diameter of the alumina fiber has been set in a range of 2.0 to 6.0 μm, may be set in a range of 1.0 to 3.0 μm. It is to be noted that when the reinforcing material is a mixture of an alumina fiber and a carbon fiber, the scratch limit characteristic or the like cannot be lost even though the carbon fiber falls off because the carbon fiber has a lubricating ability.

The above-described average diameter of the alumina fiber is referred to as an average value of the diameters of the individual filaments because of their different diameters. When the cross section of the filament of the alumina fiber is non-circular rather than circular, such as oval or polygonal, the diameter of a filament having a non-circular cross section is determined from the cross-sectional area of the filament as compared to a circular filament of the same cross-sectional area.

Figure 10:
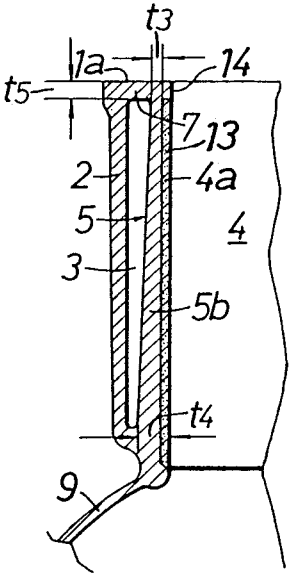
FIG. 10 is a sectional elevation view taken along the line X—X of FIG. 9.
Figure 9:
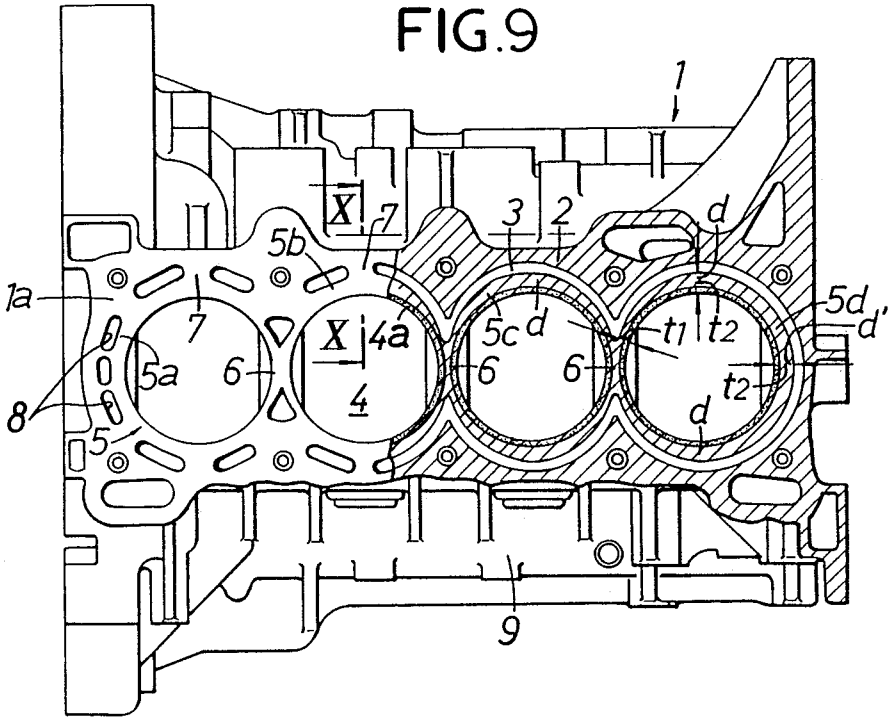
FIG. 9 is a plan view of another siamese type cylinder block with portions shown in section.

FIGS. 9 and 10 show another siamese type cylinder block 1 which is the same as cylinder block 1 of FIGS. 1–3 in most respects and therefore only the differences will be described. In this cylinder block, the thicknesses of the adjacent cylinder barrels 5*a* to 5*d* varies around the cylinder. Between the juncture or connection 6 of adjacent cylinders and a point d of the cylinder barrel lying on a diametrical line perpendicular to a line in the direction of the plural cylinder barrels (i.e. parallel to the engine crankshaft, not shown), the thickness of the cylinder barrel gradually increases from the connection 6 to such point d , as clearly shown in FIG. 9 (i.e., $t1<t2$). The thickness of the cylinder barrels 5*a and 5d* at each end of the cylinder block at their outer half peripheries is set at a value equal to the thickness at the portion d, i.e. at t2, of the interior cylinders 5*b* and 5*c*.

With such a cylinder barrel construction, the portions of the cylinder barrels other than the portion in the vicinity of the connection 6 of each the cylinder barrels 5*a* to 5*d* is more difficult to cool because of the increased thickness. This enables the circumferential distribution in the temperature of each of the cylinder barrels 5*a* to 5*d* to be substantially uniform, so that the magnitude of thermal expansion of each of the cylinder barrels will be substantially uniform in the circumferential direction. Consequently, it is possible to prevent an increase in the amount of a blow-by gas and in the consumption of oil that would otherwise occur with unequal thermal expansion around the circumference with each of the cylinder barrels 5*a* to 5*d* which tends to cause a non-circular shape of the cylinder barrel.

In addition, by increasing the thicknesses of each the cylinder barrels 5*a* to 5*d* as described above, the volume of each of the casting cavities thereof increases. Therefore, it is possible to inhibit the reduction in temperature of a molten metal due to the increase in amount of the molten metal during casting and to enhance the fillability and compoundability of the molten metal to the shaped fiber thus improving the quality of the cast product.

Further, clearly shown in FIG. 10, each of the cylinder barrels 5*a* to 5*d* preferably has a wall thickness that gradually increases in the axial direction from the upper end at surface 1*a* of the water jacket 3 which is to be connected to the cylinder head toward the lower end (i.e., $t3<t4$). This makes it possible to reduce the rate of the cooling of the bottom portion of the water jacket 3 which is at a relatively low temperature during operation of an engine, thereby permitting the axial distribution in temperature of each of the cylinder barrels 5*a* to 5*d* to be substantially uniform.

In each of the cylinder barrels 5*a* to 5*d*, the fiber-reinforced aluminum alloy layer or sleeve portion 13 is buried below the surface 1*a* and the upper end surface of the alloy portion 13 is covered with an annular portion 14 comprised of only aluminum alloy. The reason for such construction is that if the upper end surface of the shaped fiber sleeve is exposed to the upper surface 1*a* during the casting of the cylinder block 1, the temperature of the molten aluminum alloy decreases when the molten metal reaches the area of the surface 1*a* because the molten metal is poured into the cavity from the side where the crank case will be formed and, as a result, the filling of the molten metal in the fiber molded sleeve product would be incomplete in the vicinity of the surface 1*a*.

If the fiber-reinforced aluminum alloy layer or sleeve portion 13 is buried under the surface 1*a* as described above, the upper end surface of the shaped fiber sleeve will be spaced from the area where the surface 1*a* will be formed during casting and therefore the molten metal will reliably fill in and compound to the whole of the shaped fiber sleeve without the occurrence of the aforesaid problem. The level of the upper end surface of the fiber-reinforced aluminum alloy layer or sleeve portion 13 is set such that the upper end surface may lie closer to the surface 1*a* than the top ring 11 of the piston 10 when the piston is at the uppermost point of travel. In view of this and the fillability and compoundability of the molten metal, it is desirable that the thickness of the aforesaid annular portion 14 be 1 mm or more.

The fiber-reinforced aluminum alloy layer or sleeve portion 13 has poor heat conductivity characteristics and therefore if the upper end surface of the reinforced alloy portion 13 reaches the surface 1*a*, the cooling efficiency would be decreased in the vicinity of that opening of each the cylinder barrels 5*a* to 5*d* but the provision of the annular portion 15 made of an aluminum alloy alone as described above makes it possible to improve the cooling efficiency in the vicinity of the opening of each the cylinder barrels 5*a* to 5*d*.

Further, the cooling efficiency is also improved by providing a thickness t5 of the reinforcing deck portion 7 of a value substantially equal to that of the annular portion 14 whereby substantially the entire periphery of the fiber-reinforced aluminum alloy layer or sleeve portion 13 is surrounded by the water jacket 3.

It should be noted that if the cooling water in the water jacket 3 tends to stagnate at the portions thereof which face the outer half peripheral portions of the cylinder barrels 5*a* and 5*d* lying on the opposite ends of the engine, then the thickness of such outer half peripheral portions may be reduced less than the thickness of the points d lying on the diametrical lines of the cylinder barrels. For example, the thicknesses of each the cylinder barrels 5*a* and 5*d* may be gradually decreased from the point d toward a point d' lying on a diametrical line of the cylinder barrels in the direction of the line of cylinder barrels. On the contrary, if the cooling efficiency at the point d' of the outer half peripheral portion of each the cylinder barrels 5*a* and 5*d* is better than that of the point d, then the thickness of the point d' may be increased to be larger than that of the point d.

Summarizing certain of the details, features and advantages of the invention, the setting of the alpha rate of the alumina fiber in a range of 10.0 to 50.0% as described above enables the alumina fiber to have a higher strength and a scratch hardness suitable for a slide support member. If the alpha rate is less than 10.0%, the scratch hardness decreases, whereas if the alpha rate exceeds 50.0%, the scratch hardness increases and as a result, the alumina fiber becomes unsuitable for a slide support member. There is also a disadvantage that if the alpha rate exceeds 50.0%, the alumina fiber is brittle.

In addition, with the volume content of the alumina fiber having an alpha rate in the range of 8.0 to 20.0% as described above, the slide portion of the aluminum alloy slide support member will be satisfactorily fiber-reinforced and the seizure and wear resistances of the slide portion will be improved and moreover, the amount of wear of the mating materials can be reduced. If the volume content is less than 8.0%, the ability of the fiber to reinforce the slide portion is reduced and the wear and seizure resistances of the slide portion decreases. On the other hand, if the volume content exceeds 20.0%, the fillability of the molten aluminum alloy into the fiber matrix is reduced and adversely effects the fiber-reinforcement. In addition, the hardness of the slide portion increases to cause an increase in the amount of mating material wear and reduce the heat conductivity.

Further, by constructing a slide support member of the hybrid type by using a reinforcing material produced from the mixing of an alumina fiber having a volume content of 50.0% or less with a carbon fiber having a volume content of 20.0% or less, the seizure limit characteristics and scratch limit characteristics of the slide support member will be improved as compared with a slide support member produced using only an alumina fiber. In the mixed reinforcing material, however, if the volume content of the alumina fiber exceeds 50.0%, the total volume content increases in relationship to the amount of the carbon fiber, resulting in reduced fillability of the matrix. If the volume content of the carbon fiber exceeds 20.0%, the total volume content increases in relationship to the amount of the alumina fiber and consequently, in producing a molded product using the resultant reinforcing material, the moldability may be reduced.

Still further, in the siamese type cylinder block, if the thicknesses of each cylinder barrel are set as described above, the portions of each cylinder barrel that are most difficult to cool due to higher temperatures or due to the poor coolant water circulation are thinner than other portions of the cylinder barrels whereby the temperature of cylinder barrel walls is relatively uniform and in turn the thermal expansion of such walls in the circumferential direction is relatively uniform for maintaining a cylindrical shape. Consequently, it is possible to prevent an increase in the amount of blow-by gas and in the consumption of oil that would otherwise occur with a non-uniform expansion of each cylinder barrel to form a non-circular barrel.

Although the present invention has been described in connection with a preferred embodiment and modifications thereof, it will readily appear to those skilled in the art that there are numerous other applications and modifications of this invention that are possible within the scope of the appended claims.

What is claimed is:

1. An aluminum alloy slide support member in which a slide portion is made of a fiber-reinforced aluminum alloy containing at least an alumina fiber as a reinforcing material, wherein the alpha rate of said alumina fiber is in a range of 10.0 to 50.0% and the volume content of said alumina fiber is set in a range of 8.0 to 20.0%, and wherein said alumina alloy slide support member comprises a cylinder block for an internal combustion engine, and said slide portion comprises an inner wall of a cylinder bore.

2. An aluminum alloy slide support member according to claim 1, wherein the surface roughness of said cylinder block is at a value of half or less of the average diameter of said alumina fiber.

3. An aluminum alloy slide support member according to claim 1 wherein the surface roughness of said cylinder block is at 3.0 μm or less.

4. An aluminum alloy slide support member according to claim 1 wherein said alpha rate is in a range of 30.0 to 40.0%.

5. An aluminum alloy slide support member according to claim 1, wherein said volume content is in a range of 12.0 to 14.0%.

6. An aluminum alloy slide support member according to claim 1, wherein said cylinder block is of a siamese type including a cylinder block outer wall and a siamese type cylinder barrel portion forming a water jacket therebetween, said siamese type cylinder barrel portion comprising a plurality of cylinder barrells each having a cylinder bore and connected in series through connections.

7. An aluminum alloy slide support member according to claim 6, wherein the thickness of each of the adjacent cylinder barrels between said connection and a point lying on a diametrical line perpendicular to a line in the direction of the aligned cylinder barrels gradually increases from said connection toward said point.

8. An aluminum alloy slide support member in which a slide portion is made of a fiber-reinforced aluminum alloy containing at least an alumina fiber as a reinforcing material, wherein said reinforcing material consists of an alumina fiber and a carbon fiber; the alpha rate of said alumina fiber is in a range of 10.0 to 50.00%; the volume content of said alumina fiber is at 50.0% or less; and the volume content of said carbon fiber is at 20.0% or less, and wherein said aluminum alloy slide support member comprises a cylinder block for an internal combustion engine, and said slide portion comprises an inner wall of a cylinder bore.

9. An aluminum alloy slide support member according to claim 8, wherein the volume content of said alumina fiber is in a range of 10.0 to 50.0%, and the volume content of said carbon fiber is in a range of 3.0 to 12.0%.

10. An aluminum alloy slide support member according to claim 8 wherein the surface roughness of said cylinder block is at 3.0 μm or less.

11. An aluminum alloy slide support member according to claim 8 wherein said alpha rate is in a range of 30.0 to 40.0%.

12. An aluminum alloy slide support member according to claim 8 wherein said volume content of said alumina fiber is in a range of 12.0 to 14.0%.

13. An aluminum alloy slide support member according to claim 8, wherein said cylinder block is of a siamese type including a cylinder block outer wall and a siamese type cylinder barrel portion comprising a plurality of cylinder barrels each having a cylinder bore and connected in series through connections.

14. An aluminum alloy slide support member according to claim 13, wherein the thickness of each of the adjacent cylinder barrels between said connection and a point lying on a diametrical line perpendicular to a line in the direction of the aligned cylinder barrels gradually increases from said connection toward said point.

15. An aluminum alloy slide support member according to claim 8 or 9, wherein the surface roughness of said cylinder block is at a value of half or less of the average diameter of said alumina fiber.

16. An aluminum alloy slide support member comprising a cylinder block of an internal combustion engine having at least one cylinder with an inner wall for slidably supporting a piston, said inner wall having a layer portion formed of a matrix of reinforcing alumina fiber filled with aluminum alloy, and said alumina fiber having an alpha rate in the range of about 10% to 50%.

17. The aluminum alloy slide support member of claim 16 wherein the volume content of said alumina fiber is 50% or less.

18. The aluminum alloy slide support member of claim 16 or 17 wherein said layer portion includes carbon fibers.

19. The aluminum alloy slide support member of claim 18 wherein the volume content of said carbon fibers is 20% or less.

20. The aluminum alloy slide support member of claim 18 wherein the volume content of said carbon fibers is about 3% to 12% and the volume content of said alumina fibers is about 12% to 14%.

21. The aluminum alloy slide support member of claim 20 wherein the alpha rate is about 30% to 40%.

22. The aluminum alloy slide support member of claim 16 wherein each cylinder is formed of a cylinder barrel having a wall of varying thickness for substantially equalizing the cooling, temperature, and thermal expansion throughout the wall.

23. A slide support member comprising a cylinder block of an internal combustion engine having at least one cylinder with an inner wall for slidably supporting a piston, said inner wall having a layer portion formed of a matrix of reinforcing alumina fiber filled with aluminum alloy, and said cylinder being formed of a cylinder barrel having a wall of varying thickness substantially equalizing the cooling, temperature and thermal expansion throughout the wall for maintaining the cylindrical shape of the cylinder.

24. The slide support member of claim 23 wherein the cylinder block has plural cylinders in a line with the cylinder walls of adjacent cylinders joined at a connection, and the wall of each cylinder at said connection is thinner than the remainder of the wall.

25. The slide support member of claim 24 wherein the cylinder wall thickness varies substantially uniformly from each said connection to a point most remote from each said connection.

26. The slide support member of claims 23, 24 or 25 wherein the cylinder wall varies in thickness from one axial end to the other.

* * * * *